United States Patent [19]

Yamagata

[11] 4,170,104

[45] Oct. 9, 1979

[54] SWITCH MECHANISM FOR WRISTWATCH

[75] Inventor: Hisao Yamagata, Tokorozawa, Japan

[73] Assignee: Citizen Watch Company Limited, Japan

[21] Appl. No.: 856,189

[22] Filed: Nov. 30, 1977

[30] Foreign Application Priority Data

| | | | |
|---|---|---|---|
| Dec. 1, 1976 | [JP] | Japan | 51-159856[U] |
| Dec. 1, 1976 | [JP] | Japan | 51-159857[U] |
| Dec. 25, 1976 | [JP] | Japan | 51-175084[U] |
| Feb. 22, 1977 | [JP] | Japan | 52-18487 |

[51] Int. Cl.[2] ..... G04C 3/00

[52] U.S. Cl. ..... 58/23 R; 200/159 B; 200/302; 200/DIG. 25

[58] Field of Search ..... 200/DIG. 25, 302, 159 B; 58/23 R, 50 R, 85.5

[56] References Cited

U.S. PATENT DOCUMENTS

| | | | |
|---|---|---|---|
| 3,767,875 | 10/1973 | Schniekart | 200/159 B |
| 4,007,347 | 2/1977 | Haber | 58/85.5 |
| 4,031,341 | 6/1977 | Wuthrich | 58/85.5 |

*Primary Examiner*—J. V. Truhe
*Assistant Examiner*—Leonard W. Pojunas, Jr.

[57] ABSTRACT

A switch mechanism for a wristwatch having a case and a substrate mounted in the case, which comprises conductive contact means disposed on the substrate to be in registration with a switch position of the switch mechanism, stepped bore means provided in alignment with the contact means, a diaphragm assembly including a flange, an embossed portion integral with the flange, and a contact element provided on a bottom wall of the embossed portion to be in alignment with the contact means, pressure ring means for compressing the flange to retain the diaphragm assembly in place while providing a water-tight sealing effect, and push-button means disposed in the stepped bore means and normally engaging the embossed portion of the diaphragm assembly, said push-button means being movable to press the embossed portion and the contact element toward the contact means to close the switch mechanism when the push-button means is depressed.

22 Claims, 19 Drawing Figures

SWITCH MECHANISM FOR WRISTWATCH

This invention relates to switch mechanisms and, more particularly, to a switch mechanism advantageously suitable for use as a push-button type switch for a wristwatch.

In push-button type switches for wristwatches there are known in the art push-button type switches which make use of a waterproof elastomeric member such as a piece of rubber which serves to restore push-buttons to their original positions, the elastomeric member being secured in place by sandwiching and compressing it between the timepiece movement and case. However, a structure of this type was defective in that watertightness and restoring force were lost whenever an excessive external force caused a portion of the elastomeric member embraced between the movement and case to be released, as was likely if the wristwatch was accidentally dropped or a push-button excessively depressed. The possibility of these defects occuring increases in proportion to the number of push-buttons, particularly in timepieces that make use of a plurality of push-buttons, such as stopwatches or timepieces equipped with an electronic calculator.

It, therefore, an object of the present invention to provide a switch mechanism which can overcomes the shortcomings encountered in prior art.

It is another object of the present invention to provide a switch mechanism suited for use in an electronic wristwatch.

It is another object of the present invention to provide a switch mechanism which is highly reliable in operation, inexpensive to manufacture and possesses watertightness and restorability.

It is another object of the present invention to provide a miniaturized switch mechanism specifically suited for a wristwatch.

These and other objects, features and advantages of the present invention will become more apparent from the following description when taken in conjunction with the accompanying drawings, in which.

Figure 1:
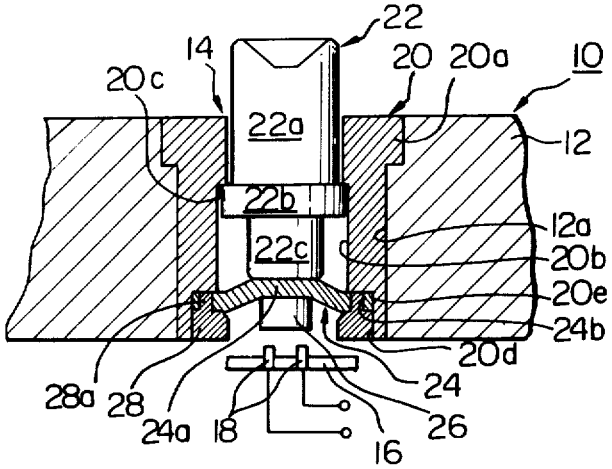
FIG. 1 is a fragmentary cross sectional view of a portion of a wristwatch equipped with a preferred embodiment of a switch mechanism according to the present invention.

Referring now to FIG. 1, there is shown in cross section a portion of a wristwatch provided with a switch mechanism according to the present invention. The wristwatch 10 comprises a case 12 having a stepped bore **12*a* composed of a first or large-diameter bore formed adjacent an upper surface of the case 12, and a second or small-diameter bore formed adjacent a lower surface of the case 12, to accommodate a switch mechanism 14 according to the present invention. The wristwatch 10 also comprises a substrate 16, on which a plurality of segments of conductive material 18 serving as conductive contact means forming part of the switch mechanism 14 are disposed to be in registration of a switch position of the switch mechanism 14**.

The switch mechanism 14 comprises a guide sleeve 20 secured in the stepped bore **12*a* of the case by press-fitting or an adhesive so as to provide a water-tight seal therebetween. The guide sleeve 20 may consist of a metal or relatively hard synthetic resin. The guide sleeve 20 has a flange 20*a* formed at an upper portion, the flange 20*a* being fitted to the large-diameter bore of the case 12. The guide sleeve 20 also has an annular shoulder 20*c* and a stepped guide bore 20*b* formed to be in registration with the contact means 18 placed on the substrate 16, the guide bore 20*b* slidably accommodating therein a push-button or plunger 22. The guide sleeve 20 further has at its lower end a second bore 20*d* larger in diameter than the stepped bore 20*b*** for a reason to be described in detail hereinafter.

The push-button 22 may be right circular cylinder comprising a first or upper section **22*a* adapted to be slidable within a large-diameter portion of the stepped guide bore 20*b*, a second or flange section 22*b* adapted to normally rest on the annular shoulder 20*c* of the guide sleeve 20, and a third or lower section 22*c* which may be small in diameter than the first section 22*a***.

Disposed in the second bore **20*d* of the guide sleeve 20 is a diaphragm assembly or member 24 which serves as a contact member. The diaphragm member 24 comprises an embossed portion 24*a* having its upper surface adapted to be in engagement with and retain a bottom end of the push-button 22 by which it is held in engagement with the annular shoulder 20*c* of the guide sleeve 20, and its lower surface provided with a conductive contact element 26 at a position to be in registration with the contact means 18 on the substrate 16. The diaphragm member 24 may be of an elaastomeric material such as a polyurethane elastomer, and the contact element 26 may be of a conductive rubber and secured to the lower surface of the embossed portion 24*a* of the contact member by any known technique. The diaphragm member 24 is provided with a radial distortion preventive means in the form of a plurality of engagement bores 24***b*.

Press-fitted to the second bore 20*d* of the guide sleeve 20 is an annular pressure ring or retainer 28 having its upper surface held in pressured contact with the lower surface of the circumferential portion of the contact member 24, to seal the diaphragm or contact member 24 against water, dust and dirt. The pressure ring 28 may be of a metallic material and has a plurality of upwardly projecting engagement portions 28*a* fitted to the corresponding engagement bores 24*b* of the contact member 24 to prevent the contact member 24 from being distorted in a radial direction during a course of a switching operation to provide a satisfactorily water-tight sealing effect between the guide sleeve 20 and the diaphragm member 24.

With the arrangement mentioned above, the push-button or plunger 22 is normally held in an open state in which the plunger 22 is retained in place by the diaphragm member 24 such that the flange 22*b* of the plunger 22 is held in engagement with the annular shoulder 20*c* of the guide sleeve 20. When it is desired to close the switch mechanism, the plunger 22 is depressed inward by some suitable means such as a pin. In this case, the embossed portion 24*a* of the diaphragm member 24 is pressed downward and, accordingly, the contact element 26 is brought into contact with the contact means 18 on the substrate 16, thereby providing an electrical connection between the contact means 18. Under this circumstance, if the plunger 22 is released, then the plunger 22 is moved outward to its original rest position by the action of the diaphragm member 24 and, thus, the plunger 22 is held in its rest position as previously noted.

Figure 2:
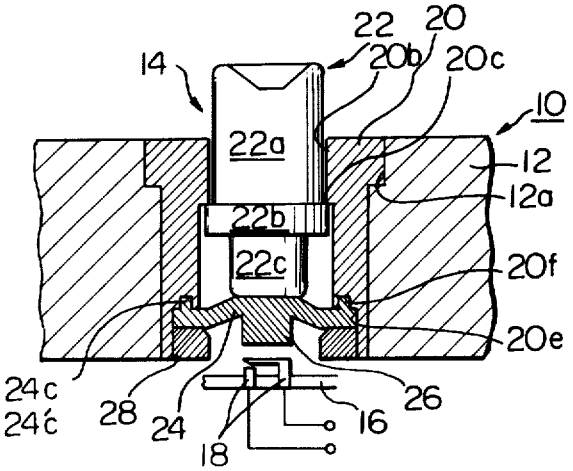
FIG. 2 is a cross section illustrating a modified form of the switch mechanism shown in FIG. 1.
Figure 3:
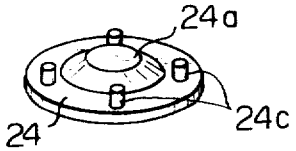
FIG. 3 is a perspective view of one example of a part shown in FIG. 2.
Figure 4:
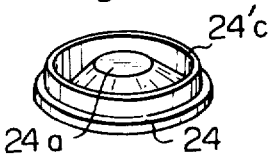
FIG. 4 is a perspective view of another example of the part shown in FIG. 2.

A modified form of the switch mechanism is shown in FIG. 2 in which like or corresponding component parts are designated by the same reference numerals as those used in FIG. 1. In this modification, the upward projections 28*a* of the pressure ring 28 and the engagement bores 24*b* of the diaphragm member 24 are dispensed with and, instead thereof, the radial distortion preventive means comprises upwardly extending engagement means 24*c* or 24'*c*, which are fitted to the corresponding recess means 20*f* formed on the annular shoulder 20*e* of the guide sleeve 20. FIG. 3 shows one example of a modified diaphragm member 24, with the upwardly projecting engagement means 24*c* comprising a plurality of engagement pins. In this case, the recess means 20*f* of the guide sleeve 20 comprises a plurality of circular bores extending axially of the plunger 22. FIG. 4 shows another example of a modified diaphragm member 24, with the upwardly projecting engagement means 24'*c* comprising an annular ring as shown. In this case, the recess means 20*f* of the guide sleeve 20 may comprise an annular recess formed on the annular shoulder 20*e* of the guide sleeve 20.

It is to be noted that the diaphragm or contact member 24 are tightly retained between the annular shoulder 20*e* of the guide sleeve 20 and the pressure ring 28 press-fitted to the second bore 20*d* of the guide sleeve whereby undesirable radial distortion of the diaphragm member 24 is prevented to provide a highly reliable switching operation and a water-tight sealing effect. These are further enhanced by the provision of the radial distortion preventive means provided on the diaphragm member 24.

Figure 5:
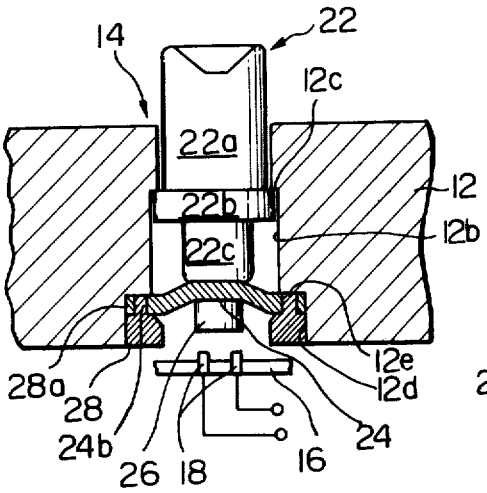
FIG. 5 is a fragmentary cross sectional view of another preferred embodiment of a switch mechanism according to the present invention.

FIG. 5 shows a second preferred embodiment of a switch mechanism according to the present invention, with like parts bearing the same reference numerals as those used in FIG. 1. In the illustrated embodiment of FIG. 5, the guide sleeve 20 is dispensed with and, instead thereof, the case 12 is formed with a stepped bore 12*b* having an annular shoulder 12*c*, and a recess 12*d* larger in diameter than the stepped bore 12*b*. The push-button 22 is slidably disposed in the stepped bore 12*b* of the case 12 such that the flange 22*b* normally rests on the annular shoulder 12*c* of the case 12. The diaphragm member 24 is disposed in the recess 12*d* of the case 12 and fixedly retained by the pressure ring 28 with its upwardly extending projections 28*a* engaging the corresponding recesses 24*b* of the diaphragm member 24.

Figure 6:
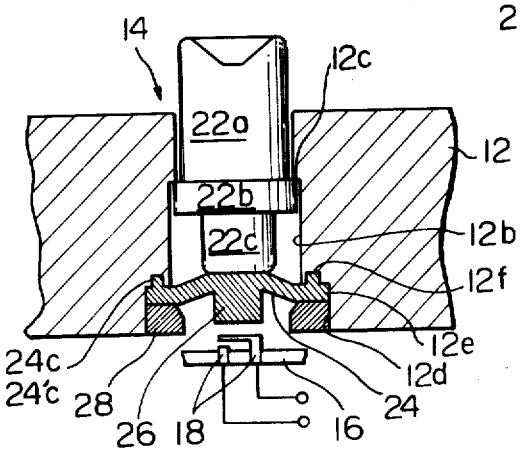
FIG. 6 is a cross section of a modified form of the switch mechanism shown in FIG. 5.
Figure 6:
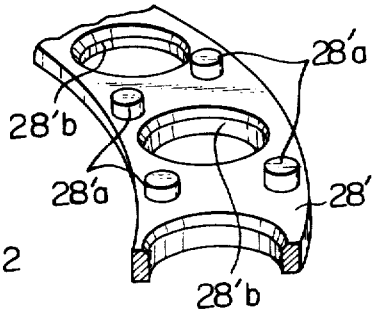

FIG. 6 shows a modified form of the switch mechanism shown in FIG. 5. This illustrated embodiment is similar in construction as that shown in FIG. 2 except that the guide sleeve 20 is dispensed with and the diaphragm member 24 and the pressure ring 28 are disposed in the second bore 12*d* of the case 12. An engagement recess means 12*f* is formed in the annular shoulder 12*e* of the case, to accommodate therein a radial distortion preventive means in the form of upwardly extending projecting means 24*c* or 24'*c*. In a case where the upwardly projecting means comprises a plurality of circumferentially spaced projections 24*c*, the recess means 12*f* may comprise a plurality of axial bores. In another case where the upwardly projecting means comprises an annular ring 24'*c* as shown in FIG. 4, the recess means 12*f* may comprise an annular recess.

Figure 7:
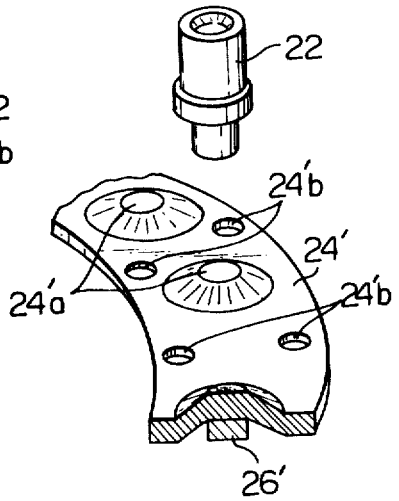
FIG. 7 is a fragmentary exploded view showing an example of a modification of parts for the structure shown in FIG. 6.

In the structure shown in FIGS. 5 and 6, the recess 12*d* may be of a circular configuration and the diaphragm 24 may be of a circular shape. However, the recess 12*d* of the case may be of an annular configuration formed at a lower surface of the case 12, and a diaphragm member 24' comprises an annular ring a portion of which is shown in FIG. 7. The annular ring 24' is adapted to be press-fitted to the annular recess of the case 12. A plurality of embossed portions 24'*a* are provided on the annular ring 24' in circumferentially spaced positions. A plurality of conductive member 26' are secured to the lower surface of each embossed portion. The annular ring 24' is also provided with a plurality of engagement bores 24'*b*. A pressure ring 28' shown in FIG. 5 is press-fitted to the annular recess of the case 12 to retain the diaphragm assembly 24' in a fixed place as shown in FIG. 5. Indicated at 28'*b* is a circular bore formed in registration with the embossed portion 24'*a* of the annular diaphragm assembly 24', to permit movement of contact element 26' toward and away from the contact means 18.

Figure 8:
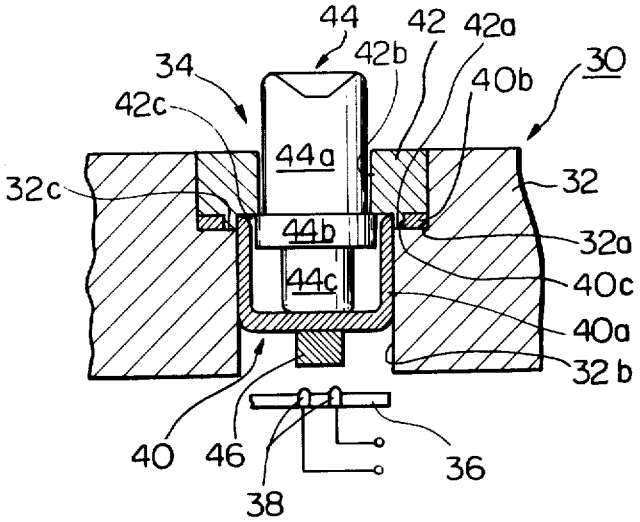
FIG. 8 is a cross sectional view of another preferred embodiment of a switch mechanism according to the present invention.

FIG. 8 shows another preferred embodiment of a switch mechanism according to the present invention for use in a wristwatch 30. The wristwatch 30 comprises a case 32 having a stepped bore composed of a first or large-diameter bore 32*a* formed adjacent an upper surface of the case 32, and a second or small-diameter bore 32*b* formed adjacent a lower surface of the case 32, to accommodate a switch mechanism 34 according to the present invention. The wristwatch 30 also comprises a substrate 36, on which a plurality of segments of conductive material 38 serving as conductive contact means forming part of the switch mechanism 34 are disposed to be in registration of a switch position of the switch mechanism 34.

The switch mechanism 34 comprises a diaphragm assembly or member 40 made of an elastomeric material and carrying at its bottom wall a conductive contact element 46 made of elastomeric conductive material such as a conductive rubber. The diaphragm assembly 40 comprises a downwardly extending cylindrical embossed portion 40a disposed in the small-diameter bore 32b of the case 32, and an annular flange 40b integral with the cylindrical embossed portion 40a and disposed in the large-diameter portion 32a of the case 32. The diaphragm member 40 is provided at its annular flange 40b with a radial distortion preventive means in the form of a plurality of engagement bores 40c. An annular pressure ring 42 is press fitted to the large-diameter portion 32a of the case 32, to compress the annular flange 40b of the diaphragm member 40 against the annular shoulder 32c of the case for thereby providing a water-tight seal therebetween. The pressure ring 42 has a plurality of projections downwardly extending thereof. The projections 34a are disposed in the engagement bores 40c of the diaphragm member 40, preventing the annular flange 40b of the diaphragm member 40 from being distorted in a radial direction during a course of switching operation. The pressure ring 42 has a bore 42b, in which a push-button or plunger 44 is disposed.

The push-button 44 may be right circular cylinder comprising a first or upper section 44a adapted to be slidable within the bore 42b of the pressure ring 42, a second or flange section 44b adapted to normally rest on a bottom wall 42c of the pressure ring 42, and a third or lower section 44c which may be small in diameter than the first section 44a. The flange 44b of the push-button 44 is smaller in diameter than the inner wall of the embossed portion 40a of the diaphragm assembly 40, and the height of the flange 44b and the lower section 44c is slightly less than that of the embossed portion 40a of the diaphragm assembly 40 such that a bottom end of the lower section 44c is held in engagement with a bottom wall of the embossed portion 40a while, at the same time, the flange 44b is held in engagement with the bottom wall 42c of the pressure ring 42.

Figure 9:
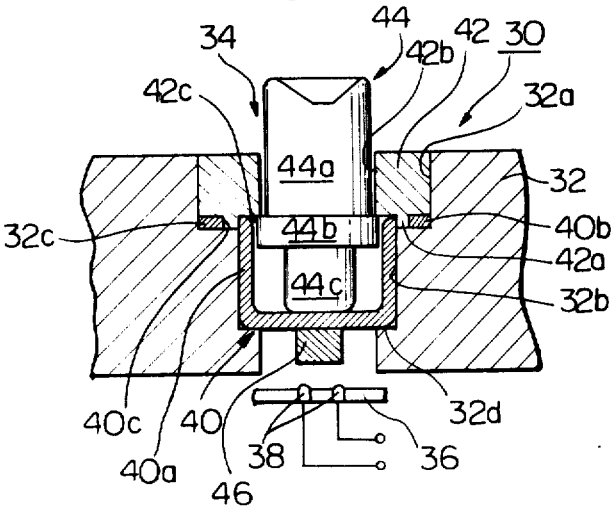
FIG. 9 is a cross section of a modification of the switch mechanism shown in FIG. 8.

FIG. 9 shows a modification of the switch mechanism shown in FIG. 8, with like or corresponding component parts bearing the same reference numerals as those used in FIG. 8. The structure of FIG. 9 is identical to that of FIG. 8 except that the case 32 is provided with an annular shoulder 32d radially extending inward from the small-diameter portion 32b. The bottom end of the embossed portion 40a of the diaphragm assembly 40 partially rests on the annular shoulder 32d of the case 32.

Figure 10:
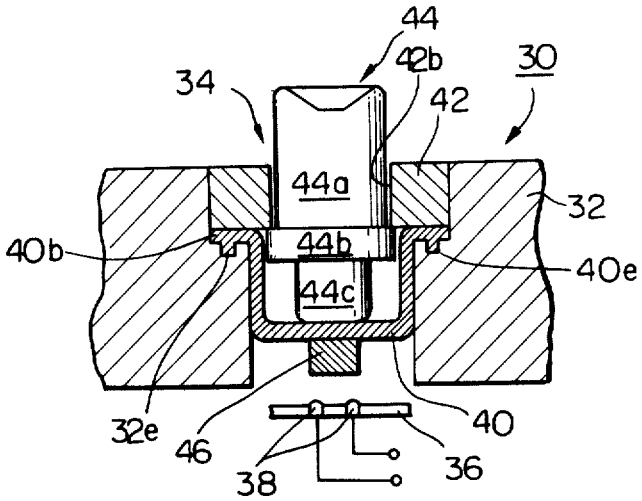
FIG. 10 is a cross section of another modification of the switch mechanism shown in FIG. 8.
Figure 11:
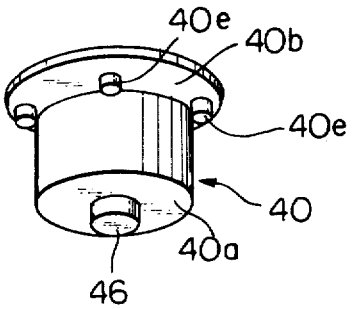
FIG. 11 is a perspective view of one example of a part for the switch mechanism shown in FIG. 10.
Figure 12:
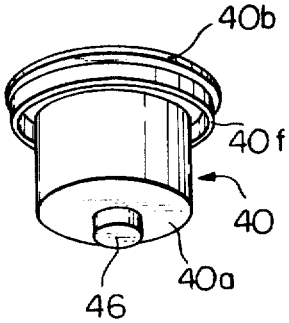
FIG. 12 is a perspective view of another example of the part for the structure of FIG. 10.

FIGS. 10 and 11 show a modified form of the switch mechanism shown in FIG. 8. In this modified form, the projections 42a of the pressure ring 42 and the engagement bores 40c of the diaphragm assembly 40 are dispensed with and, insted thereof, the diaphragm assembly 40 is provided at its annular flange 40b with a plurality of downwardly extending projections 40e which are disposed in the corresponding bores 32e of the case 32 formed at the same position as the projections 40e. The projections 40e of the diaphragm assembly 40 may be replaced by an annular ring portion 40f which extends downward as shown in FIG. 12.

Figure 13:
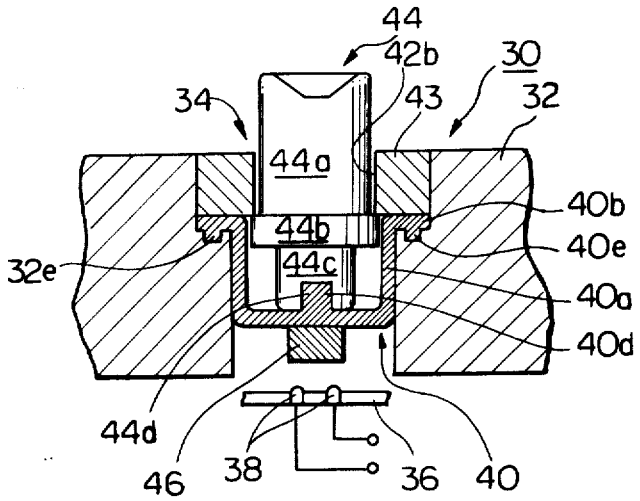
FIG. 13 is a cross section of still another modification of the switch mechanism shown in FIG. 8.

FIG. 13 shows another modification of the switch mechanism shown in FIG. 10. In this modification, the inner side of the bottom wall of the embossed portion 40a of the diaphragm assembly 40 is provided with an upwardly extending projection 40d that is fitted in an engaging hole 44d formed at the bottom end of the push-button 44, so as to effect smooth movement of the push-button 44 within the bore 42b of the pressure ring 42.

Figure 14:
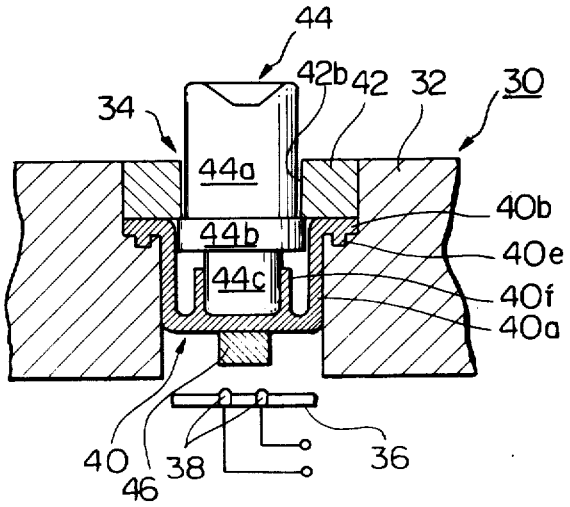
FIG. 14 is a cross section of a further modification of the switch mechanism shown in FIG. 8.

FIG. 14 is yet another modification of the switch mechanism in which the inner side of the bottom surface of the diaphragm assembly 40 is provided with an upwardly extending cylindrical wall 40f that is fitted around the outer circumference of the lower section 44c of the push-button 44.

Figure 15:
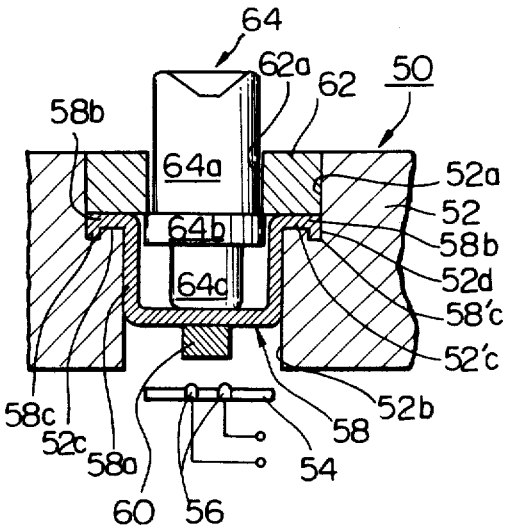
FIGS. 15 and 16 show a still further modification of the switch mechanism shown in FIG. 8.
Figure 16:
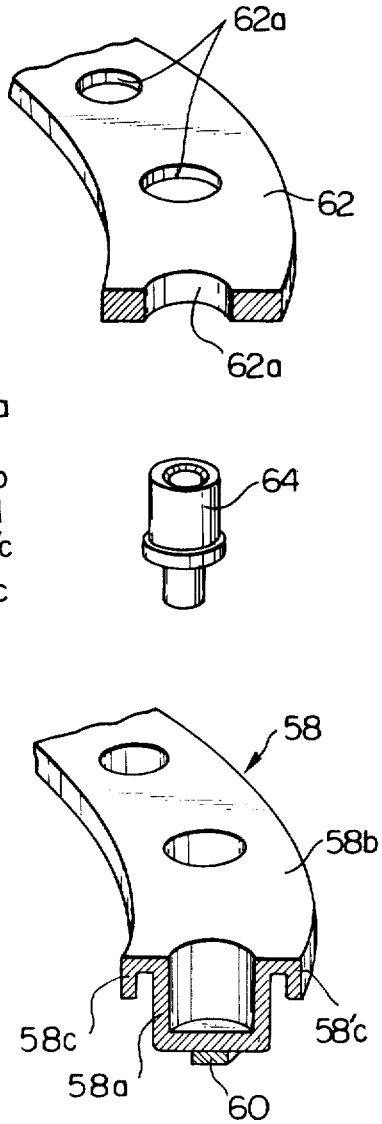

FIGS. 15 and 16 show another preferred embodiment of a switch mechanism according to the present invention, the switch mechanism being applied to a wristwatch in which a plurality of push-buttons forming part of the switch mechanism of the present invention are arranged in a circumferential area of a watch case even though only one push-button is shown in FIGS. 15 and 16. In this illustrated embodiment, the wristwatch 50 comprises a case 52, and a substrate 54 disposed within the case 52 and supporting thereon a plurality of conductive contact means 56. The case 52 has a first annular recess 52a formed along a circumferential periphery of the case 12, and a second annular recess 52b continuous with the first annular recess 52a, first and second radially extending annular shoulders 52c and 52'c being formed between the first and second annular recesses 52a and 52b. Each of the annular shoulders of the case 52 is provided with an annular recess 52d at a position adjacent a side wall of the first annular recess 52a.

Disposed in the first annular recess 52a of the case is a diaphragm assembly 58 in the form of an annular ring 58b, the lower surface of which is provided with circumferentially spaced embossed portions 58a. The embossed portions 58a are received in the annular recess 52b of the case 52 as shown in FIG. 15. Each of the embossed portions 58a is provided at its bottom end with a conductive contact element 60 made of an elastomeric material such as conductive rubber. The annular ring 58b has first and second downwardly extending flanges 58c and 58'c formed at inner and outer peripheries of the annular ring 58b. The diaphragm assembly 58 thus arranged is disposed in the first annular recess 52a of the case 52 and compressed by a pressure ring or retainer 62 press-fitted to the recess 52a. The pressure ring 62 has an annular shape in which a plurality of guide bores 62a are formed in a circumferentially spaced relationship to be in registration with the embossed portions 58a of the diaphragm assembly 58. In this case, the downwardly extending flanges 58c and 58'c are fitted to the annular recesses 52d of the case 52.

Slidably disposed in the guide bore 62a of the pressure ring 62 is a push-button or plunger 64, which comprises a first or upper section 64a smaller in diameter than the guide bore 62a, a second or flange portion 64b adapted to normally rest on the bottom wall of the pressure ring 62, and a third or lower section 64c normally engaging the bottom wall of the embossed portion 58a. The flange 64b of the push-button 64 is slightly larger in diameter that the guide bore 62a, such that the push-button 64 is prevented from being moving out of the ring 62.

Figure 17:
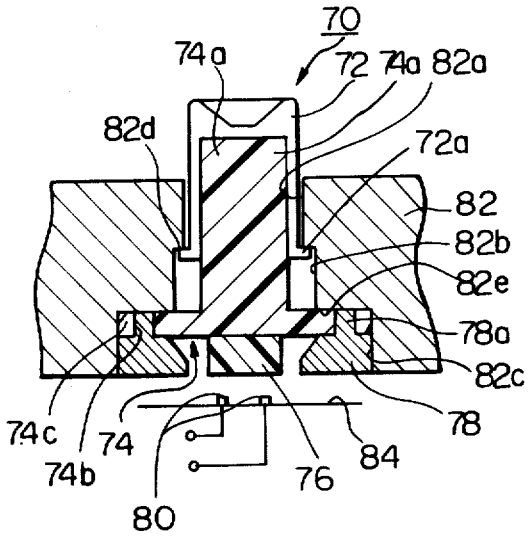
FIG. 17 is a cross section of another preferred embodiment of a switch mechanism according to the present invention.

FIG. 17 shows another preferred embodiment of a switch mechanism according to the present invention suitable for a wristwatch. The wristwatch has a case 82 formed with first, second and third bores 82a, 82b and 82c, a first annular shoulder 82d being formed between the first and second bores 82a and 82b and a second annular shoulder 82e being formed between the second and third bores 82b and 82c. A push-button 72 in the form of a cap having a bore axially extending thereof is disposed in the first bore 82*a* of the case 82 and has a radially outwardly extending flange 72*a* which normally engages at its upper surface with the first annular shoulder 82*d* of the case 82.

A diaphragm assembly 74 made of an elastomeric material has an annular flange 74*c* disposed in the third bore 82*c* of the case 82, and an upwardly extending cylindrical projection 74*a* which is partially disposed in the bore of the cap 72. The axial length of the bore of the cap 72 and the height of the upwardly extending projection 74*a* of the diaphragm assembly 74 are related such that when the projection 74*a* of the diaphragm assembly 74 is received in the bore of the cap 72 the flange 72*a* of the cap 72 is held in engagement with the first annular shoulder 82*d* of the case 82, thereby retaining the cap 72 in its proper position. The diaphragm assembly 74 is formed at its annular flange 74*c* with a plurality of circumferentially spaced engagement bores 74*b*, to which corresponding engagement projections 78*a* of a pressure ring 78 is fitted when the pressure ring 78 is press-fitted to the third bore 82*c* of the case 82 to compress the annular flange 74*c* of the diaphragm assembly 74. The diaphragm assembly 74 has at its bottom end wall provided with a contact element 76 made of an elastomeric material such as a conductive rubber to be in registration with conductive contact means 80 placed on a substrate 84.

In the embodiment of FIG. 17, the diaphragm assembly 74 absorbs even excessive pressure resulting from strongly depressing the cap 72. As a result, there is little change in the contact pressure between the electrically conductive contact element 76 and the switch contacts 80 so that neither the switch contacts nor the conductive element 76 will sustain damage, a factor which enhances switch reliability. The switch mechanism is extremely simple, including only three components, namely the cap, the diaphragm assembly which incorporates the electrically conductive contact element 76, and the pressure ring 78. Moreover, the diaphragm assembly 74 provides both watertightness and restoring force. Hence, the cost of assembly and parts can be greatly reduced as can the cost of timepieces which make use of a series of push-buttons, namely stopwatches, calculator-equipped timepieces or watches with an alarm function.

Figure 18:
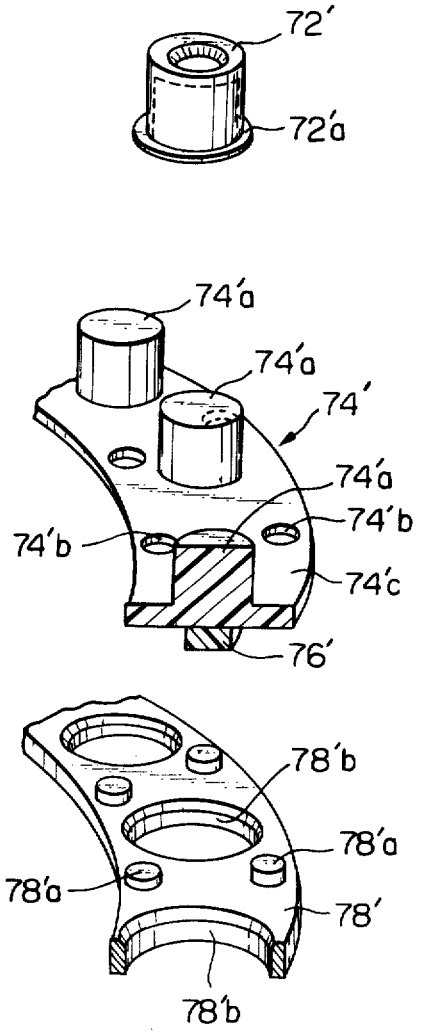
FIG. 18 is an exploded view of parts of a modification of the switch mechanism of FIG. 17.

In the embodiment of FIG. 17, the switch mechanism 70 is shown as having a discrete diaphragm assembly and pressure ring. The switch mechanism 70 may be modified such that it comprises an annular disphragm assembly 74' including a plurality of circumferentially spaced upwardly extending projections 74'*a*, and an annular pressure ring 78' having bores 78'*b* circumferentially spaced from each other to be in registration with the contact elements 76' of the diaphragm assembly 74', as shown in FIG. 18. In this modification, the third bore 82*c* of the case 82 is replaced with an annular recess (not shown) formed along the circumferential periphery of the case 82, to accommodate the diaphragm assembly 74 and the pressure ring 78'. As shown in FIG. 18, the diaphragm assembly 74' is formed with a plurality of engagement bores 74'*b*, to which corresponding projections 78'*a* of the pressure ring 78' are fitted when the pressure ring 78' is press-fitted to the annular recess of the case to compress the diaphragm assembly 74'.

Figure 19:
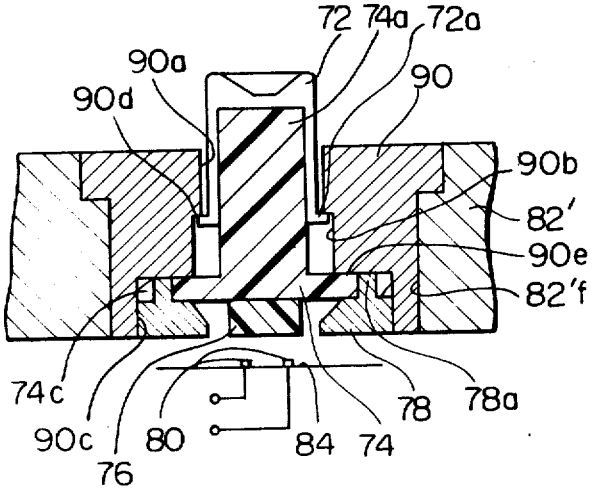
FIG. 19 is a cross section of another modification of the switch mechanism shown in FIG. 17.

FIG. 19 shows a modified form of the switch mechanism shown in FIG. 17, with like parts bearing the same reference numerals as those used in FIG. 17. The structure shown in FIG. 19 is identical to that of FIG. 17 except that the case 82' has a stepped bore 82'*f* to which a guide sleeve 90 is press-fitted to provide a watertight seal therebetween. The guide sleeve 90 has first, second and third bores 90*a*, 90*b* and 90*c*, a first annular shoulder 90*d* being formed between the first and second bores 90*a* and 90*b* and a second annular shoulder 90*e* being formed between the second and third bores 90*b* and 90*c*. The diaphragm assembly 74 and the pressure ring 78 are disposed in the third bore 90*c* of the guide sleeve 90 in the same manner as shown in FIG. 17.

While the present invention has been shown and described with reference to particular embodiments by way of examples, it should be noted that various other changes or modifications may be made without departing from the scope of the present invention.

What is claimed is:

1. A switch mechanism for a wristwatch having a case and a substrate mounted in the case, comprising:

conductive contact means disposed on said substrate to be in registration with a switch position of said switch mechanism;

stepped bore means provided in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said diaphragm assembly including a radial distortion preventive means by which the flange of said diaphragm assembly is prevented from being distorted in a radial direction, said radial distortion preventive means comprising a plurality of engagement bore means formed in the flange of said diaphragm assembly, and said pressure ring comprising a plurality of engagement projections fitted to the engagement bores of the flange of said diaphragm assembly.

2. A switch mechanism according to claim 1, in which said stepped bore means comprises a guide sleeve press-fitted to a stepped portion of said case.

3. A switch mechanism according to claim 1, in which said stepped bore means comprises said case.

4. A switch mechanism for a wristwatch having a case and a substrate mounted in the case, comprising:

conductive contact means disposed on said substrate to be in registration with a switch position of said switch mechanism;

stepped bore means provided in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said diaphragm assembly including a radial distortion preventive means by which the flange of said diaphragm assembly is prevented from being distorted in a radial direction, said radial distortion preventive means comprising upwardly extending engagement projection means formed on the flange of said diaphragm assembly, said engagement projection means being fitted to a corresponding bore formed in the annular shoulder of said stepped bore means.

5. A switch mechanism according to claim 4, in which said stepped bore means comprises a guide sleeve press-fitted to a stepped portion of said case.

6. A switch mechanism according to claim 4, in which said stepped bore means comprises said case.

7. A switch mechanism for a wristwatch having a case and a substrate mounted in the case, comprising:

conductive contact means disposed on said substrate to be in registration with a switch position of said switch mechanism;

stepped bore means provided in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said case including a plurality of stepped bores formed in alignment with a plurality of said contact means, and an annular recess having first and second annular shoulders formed along said recess, and said push-button means comprising a plurality of plungers disposed in said plurality of stepped bores, respectively, said diaphragm assembly comprising an annular ring including a plurality of said embossed portions provided with a plurality of said contact elements, respectively, in registration with the plurality of said contact means, and said pressure ring comprising an annular ring with a plurality of bores formed to be in registration with said plurality of contact elements, said diaphragm assembly being disposed in said annular recess of said case and said pressure ring being press-fitted to said annular recess of said case to compress said diaphragm assembly against the first and second annular shoulders of said annular recess of the case.

8. A switch mechanism for a wristwatch having a case and a substrate mounted in the case, comprising:

conductive contact means disposed on said substrate to be in registration with a switch position of said switch mechanism;

stepped bore means formed in said case in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said case having a large-diameter bore formed adjacent an upper surface of said case, and a small-diameter bore formed adjacent a lower surface of the case, and a radially extending annular shoulder formed between said large-diameter bore and said small-diameter bore, said flange of said diaphragm assembly being disposed in said large-diameter bore and compressed against said annular shoulder by said pressure ring which is press-fitted to said large-diameter bore, the embossed portion of said diaphragm assembly extending downward through the small-diameter bore of said case toward said contact means.

9. A switch mechanism according to claim 8, in which said case also has a third bore smaller in diameter than said small-diameter bore, and a second annular shoulder formed between said small-diameter bore and said third bore, the bottom wall of said embossed portion of said diaphragm assembly partially engaging the second annular shoulder of said case.

10. A switch mechanism according to claim 8, in which said diaphragm assembly includes a radial distortion preventive means provided at the flange of said diaphragm assembly.

11. A switch mechanism according to claim 10, in which said radial distortion preventive means comprises a plurality of circumferentially spaced bores formed in the flange of said diaphragm assembly, and in which said pressure ring includes a plurality of downwardly extending projections fitted to the bores of said flange.

12. A switch mechanism according to claim 20, in which said radial distortion preventive means comprises a plurality of circumferentially spaced downwardly extending projections provided on the flange of said diaphragm assembly, and in which the annular shoulder between said large-diameter bore and said small-diameter bore is formed with a plurality of circumferentially spaced bores to which the projections of said radial distortion preventive means are fitted.

13. A switch mechanism according to claim 10, in which said radial distortion preventive means comprises a downwardly extending annular ring formed along the flange of said diaphragm assembly, and in which said annular shoulder between said large-diameter bore and said small-diameter bore is formed with a downwardly extending annular recess to which the downwardly extending annular ring of said radial distortion preventive means is fitted.

14. A switch mechanism according to claim 8, in which said push-button means has a bore formed at its bottom end, and in which said diaphragm assembly has an upwardly extending engagement portion formed at the bottom wall of said embossed portion, the upwardly extending engagement portion being fitted to the bore of said push-button means.

15. A switch mechanism according to claim 8, in which said diaphragm assembly has an upwardly extending annular ring portion of which a lower end of said push-button means is fitted.

16. A switch mechanism for a wristwatch having a case and a substrate mounted in the case, comprising:

conductive contact means disposed on said substrate to be in registration with a switch position of said switch mechanism;

stepped bore means provided in said case in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said case including a first annular recess formed along a circumferential periphery of said case, a second annular recess, first and second radially extending annular shoulders formed between said first and second annular recesses, and said push-button means comprising a plurality of plungers, said diaphragm assembly comprising an annular ring including a plurality of circumferentially spaced and downwardly extending embossed portions provided with a plurality of said contact elements, respectively, in registration with a plurality of said contact means, and said pressure ring comprising an annular ring formed with a plurality of circumferentially spaced bores in alignment with said plurality of said embossed portions to accommodate plurality of said plungers, said flange of said diaphragm assembly being disposed in said first annular recess of said case and said pressure ring being press-fitted to said first annular recess of said case to compress the flange of said diaphragm assembly against the annular shoulder of said case.

17. A switch mechanism according to claim 16, in which said case has first and second downwardly extending annular recesses formed on said first and second radially extending annular recesses, respectively, and in which the flange of said diaphragm assembly has fist and second downwardly extending annular projections which are fitted to the downwardly extending annular recesses of said case.

18. A switch mechanism for a wristwatch having a case and a substrate mounted in the case, comprising:

conductive contact means disposed on said substrate to be in registration with a switch position of said switch mechanism;

stepped bore means provided in said case in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said case having first, second and third bores concentric with one another, a first annular shoulder formed between said first and second bores, and a second annular shoulder formed between said second and third bores, said push-button means comprising a cap movably disposed in said first bore and having a bore axially extending thereof and a radially extending annular flange normally engaging said first annular flange, and the embossed portion of said diaphragm assembly comprising an elastomeric upwardly extending projection partially received in the bore of said cap, the flange of said diaphragm assembly being disposed in said third bore of said case and compressed against the second annular shoulder of said case by said pressure ring means which is press-fitted to the third bore of said case.

19. A switch mechanism according to claim 18, in which said flange of said diaphragm assembly also comprises radial distortion preventive means.

20. A switch mechanism according to claim 19, in which said radial distortion preventive means comprises a plurality of engagement bores circumferentially spaced in said flange of said diaphragm assembly, and in which said pressure ring means comprises a plurality of upwardly extending projections which are fitted to the engagement bores of said diaphragm assembly.

21. A switch mechanism for a wristwatch having a case and a substrate mounted in the case, comprising:

conductive contact means disposed on said substrate to be in registration with a switch position of said switch mechanism;

stepped bore means provided in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said guide sleeve having first, second and third bores concentric with one another, a first annular shoulder formed between said first and second bores and a second annular shoulder formed between said second and third bores, said push-button means comprising a cap movably disposed in said first bore and having a bore extending axially thereof and a flange normally engaging the first annular shoulder, said embossed portion of said diaphragm assembly comprising an elastomeric upwardly extending projection which is partially received in the bore of said cap, the flange of said diaphragm assembly being disposed in the third bore of said guide sleeve, and said pressure ring means being press-fitted to the third bore of said guide sleeve for thereby compressing the flange of said diaphragm assembly against the second annular shoulder of said guide sleeve.

22. A switch mechanism for a wristwatch having a case and a substrate mounted in the case, comprising:

conductive contact means disposed on said substrate to be in registration with a switch position of said switch mechanism;

stepped bore means provided in alignment with said contact means;

a diaphragm assembly including a flange, an embossed portion integral with said flange, and a contact element provided on a bottom wall of said embossed portion to be in alignment with said contact means;

pressure ring means for compressing said flange to retain said diaphragm assembly in place while providing a water-tight sealing effect; and push-button means disposed in said stepped bore means and normally engaging the embossed portion of said diaphragm assembly, said push-button means being movable to press said embossed portion and said contact element toward said contact means to close said switch mechanism when said push-button means is depressed;

said case having a plurality of first and second bores concentric with one another and formed in circumferentially spaced positions of said case and annular shoulders formed between said first and second bores, respectively, and an annular recess formed in registration with said first and second bores, said annular recess having first and second annular shoulders formed therealong, said push-button means comprising a plurality of caps disposed in the first bores of said case, respectively and each having a bore axially extending thereof and an annular flange normally engaging the annular shoulder of said case, the embossed portion of said diaphragm assembly comprising a plurality of elastcmeric upwardly extending projections which are partially received in the bores of said case, respectively, and said pressure ring means comprising an annular ring press-fitted to the annular recess of said case for thereby compressing the flange of said diaphragm assembly against the first and second annular shoulders of said annular recess of the case.

* * * * *